United States Patent [19]

Bailey

[11] 4,238,178

[45] Dec. 9, 1980

[54] SLAB ROLLER MACHINE

[76] Inventor: James G. Bailey, R.D. 3, Box 249-B, Kingston, N.Y. 12401

[21] Appl. No.: 40,170

[22] Filed: May 18, 1979

[51] Int. Cl.[3] ..... B28B 3/12

[52] U.S. Cl. ..... 425/367; 264/DIG. 39; 425/363

[58] Field of Search ..... 425/367, 363, 329; 264/DIG. 39

[56] References Cited

U.S. PATENT DOCUMENTS

| | | | |
|---|---|---|---|
| 204,957 | 6/1878 | Durand | 425/373 |
| 1,440,371 | 1/1923 | Britton | 425/363 |
| 1,591,170 | 7/1926 | Lutyens | 425/363 |
| 1,997,699 | 10/1934 | Sebring et al. | 310/224 |
| 2,262,479 | 11/1941 | Waters | 425/363 |
| 2,998,623 | 9/1961 | Lawson et al. | 425/363 |
| 3,931,376 | 1/1976 | Hartmann | 264/22 |

*Primary Examiner*—James H. Derrington

[57] ABSTRACT

Apparatus for molding clay into flat slabs for subsequent processing into pottery ware or sculpture employs a drive board for containing clay which is driven through a roller assembly. The clay is contained in a canvas to avoid adhesion of the clay to the roller, while the drive board includes a second canvas which assists driving the board through the roller assembly. An improved driving system utilizes an abrasive finish on the drive roller and a rubberized bottom on the drive board, while the upper roller functions as a guide roller for the slab. The thickness of the slab is adjustable by controlling the distance between the rollers.

9 Claims, 2 Drawing Figures

SLAB ROLLER MACHINE

BACKGROUND OF THE INVENTION

The present invention relates to a slab molding machine and more particularly to apparatus for molding clay into flat slabs for processing pottery objects.

Pottery making is growing in popularity in the classroom, with hobbyists, professionals and advanced students participating. However, prior to processing clay into pottery objects, it is necessary to provide slabs of clay of relatively uniform thickness. Present techniques for slab making include manually operated or power driven roller assemblies. Such assemblies are relatively expensive in that both rollers in each assembly are driven, a number of pairs of rollers may be required, and the clay tends to adhere to the rollers so that special provision must be provided to prevent adhesion to the roller or associated table. Finally, the slab of clay, when completed, must be transported from the roller assembly to the next stage of operation without altering the uniform thickness thereof.

SUMMARY OF THE INVENTION

In accordance with the instant invention, after clay is mixed to the desired consistency in a mixer, the rollers in the slab roller machine are set to the desired thickness of the slab. The clay is formed into a general wedge shaped configuration and placed within a piece of canvas with the point of the wedge toward the roller assembly. The clay containing canvas is positioned on the upper surface of a drive board, and is folded to cover the top and bottom surfaces of the clay and thereby insulate the clay from direct contact with the remainder of the apparatus. The bottom roller of the assembly is then connected to a drive source, not shown, to function as the drive roller. By frictional contact between the abrasive surface of the drive roller and the rubber bottom of the drive board, the drive board and its clay wedges are driven through the roller assembly, the resulting action of the rollers compressing the wedge shaped clay into a flat slab having a thickness corresponding to the initial setting. A sheet of canvas designated the drive canvas is attached to the front of the drive board and is used to drive the upper roller. The improved drive capability described above requires only a single set of rollers to achieve the desired compression of the clay, while the clay slab, when completed, can be readily transported on the drive board to the next work station.

Accordingly, a primary object of the present invention is to provide an improved clay slab machine.

Another object of the present invention is to provide an improved clay slab machine comprising a drive board which transports the clay through a preset roller assembly to provide clay slabs of uniform thickness.

Another object of the present invention is to provide an improved drive system for a clay slab machine including an abrasive drive roller and a rubber bottomed drive board to facilitate the driving capability of the system during the clay compression by the roller assembly.

DESCRIPTION OF A PREFERRED EMBODIMENT

Figure 1:
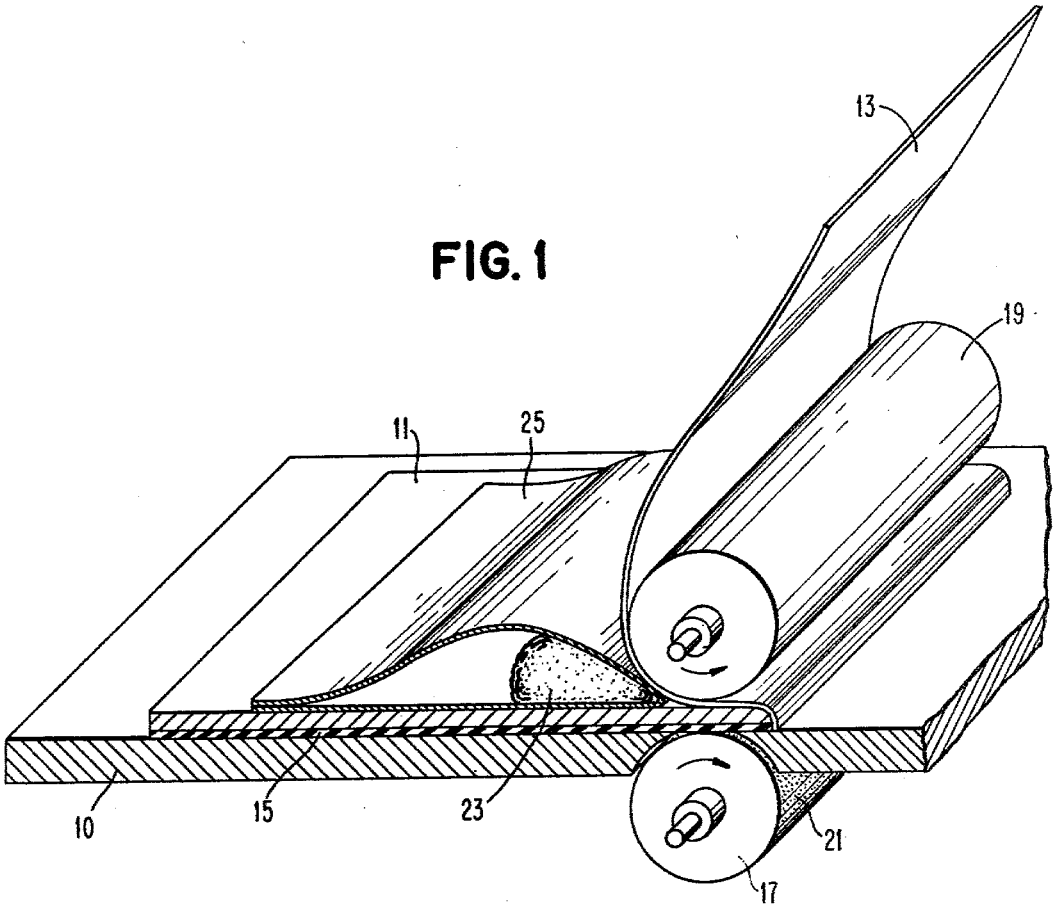
FIG. 1 is a perspective view illustrating the various components utilized in the present invention.

Referring now to the drawings and more particularly to FIG. 1 thereof, a clay slab making machine includes a drive board 11 having attached to its front edge a sheet of canvas 13 designed to cover the entire surface of the drive board shown positioned on a table or otherwise flat surface 10. Drive board 11 may be comprised of plastic, wood, etc., but includes a bottom of a rubberized material 15 such as polyurethane. A pair of rollers 17, 19 are adjusted through conventional adjusting means, not shown, to a distance to accommodate the drive board and produce the desired thickness of the clay slab on the board. As well known in the pottery art, clay slabs vary in color, consistency, and thickness in accordance with the kind of clay utilized and the form of pottery objects to be processed. Roller 17 is connected to a drive source, not shown, to produce rotation in the indicated clockwise direction, while roller 19 is a guide roller which will rotate in the opposite direction during the compression cycle. Drive canvas 13 facilitates rotation of guide roller 19 in the indicated direction. Roller 17 has an abrasive surface 21 to provide a positive frictional drive with the rubberized bottom 15 of drive board 11, while the surface of guide roller 19 is substantially smooth.

One of the problems associated with conventional clay slab formation is the tendency of the material to adhere to the surface of the apparatus, which may be a table, as well as to stick to the roller or drive mechanism. In the instant invention, a mold of clay 23 is inserted in a folded canvas sheet 25, which insulates the clay from the drive board 11 on the bottom surface and the drive canvas 13 on the upper surface, thereby preventing contamination of the drive canvas 13 with the specific clay utilized. The mold 23 is generally of wedge shape configuration, as shown, to facilitate passage through the roller assembly.

As well known in the art, the first step involved in clay slab making is preparation of the clay. The consistency of the clay should be similar to that used for throwing (forming or shaping on a potter's wheel). It is not essential to wedge the mold 23 for throwing, since the compression produced by rollers 17, 19 serves as a securing and wedging device in itself. Clay is removed from a mixer, not shown, kneaded, apliced and slammed several times to eliminate large air pockets and give the clay a slight compression. The clay in rectangular form may then be cut on a diagonal in half lengthwise to provide wedge shaped pieces of clay which are placed in the canvas sheet 25 with the point of the wedge against the rollers. If required, additional clay may be added in balanced amounts, while a slight pounding is given to ensure good contact.

Slabbing begins as the wedge shaped clay 23 is started through the turning rollers 17, 19 on drive board 11 to create the initial "bite", after which the rollers will continue to grab and compress the clay on their own. While slabbing, the rollers can be stopped at any time to add more clay and then continue the compression cycle without repeating the initial processes. It is preferred to "crank" the clay through in an even continuous motion, since stopping or making jerky movements while cranking may leave markings on the finished slab. It is also important to maintain the drive canvas 13 perpendicular to the rollers. If the canvas is initially positioned incorrectly, it could cause the slab to veer off to one side as it passes through the machine. Sewing the canvas to the drive board at the fold facilitates a faster set up time as well as maintaining both sides of the canvas in alignment.

Figure 2:
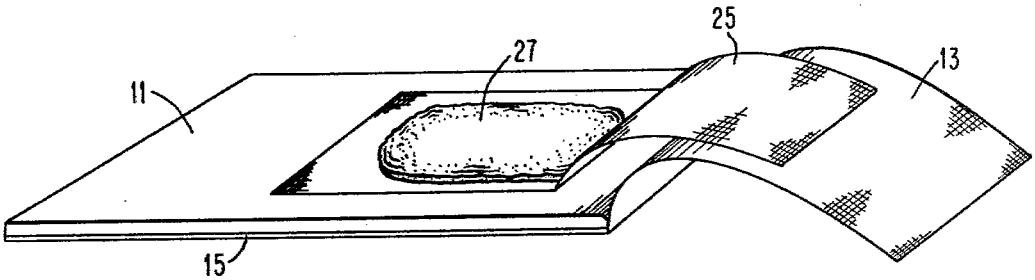
FIG. 2 illustrates the drive board and clay slab after the compression cycle.

FIG. 2 illustrates the drive board 11 and the completed slab after passing through the rollers. After the slab is complete, the drive canvas 13 is folded back. The completed slab 27 is encased within canvas 25. It should be noted that in general the configuration of the completed slab is not material since it is readily modified during the pottery making process. The protective canvas 25 is then folded back, as shown in FIG. 2, to release it from the clay. To remove the canvas 25 from the back of the slab, the opposite ends of the canvas are grasped, the slab 27 is flipped over and the canvas then pulled from the back side of the slab. With the slab thus released from the canvas, it is now available for further processing into pottery objects for utilitarian functions or for sculpture.

While the instant invention has been described in terms of an adjustable roller assembly to control the thickness of the slab, the rollers could be positioned a fixed distance relative to one another and the thickness of the slab controlled by controlling the upper level of the surface of table 10 by adding boards of the desired thickness. Similarly, while the preferred embodiment of the invention has been described in terms of single pairs of rollers, it will be understood by those skilled in the art that sets of roller assemblies could be used without departing from the spirit or scope of the instant invention.

What is claimed is:

1. Apparatus for forming clay slabs from a mass of clay for subsequent processing comprising, in combination, a discontinuous transport medium having a flat surface for supporting said clay slabs, said transport medium also functioning as a carrier for said slabs, a roller assembly comprising a pair of rollers, at least one of said rollers being power driven, said transport medium being adapted to be driven through said roller assembly, means for driving said transport medium with said mass of clay positioned thereon through said roller assembly, and means for insulating said clay mass from said roller assembly and from said flat surface of said transport medium during passage therethrough to thereby provide a slab of clay of substantially uniform thickness on said transport medium surface for subsequent processing.

2. Apparatus of the type claimed in claim 1 wherein said roller assembly is adjustable to control the thickness of said slab of clay.

3. Apparatus of the type claimed in claim 1 wherein said means for driving said discontinuous transport through said roller assembly comprises means for providing frictional engagement between said transport medium medium and an associated one of said rollers.

4. Apparatus of the type claimed in claim 3 wherein said discontinuous transport medium comprises a drive board adapted to be driven through said roller assembly.

5. Apparatus of the type claimed in claim 3 wherein said means for providing frictional engagement between said transport medium and said associated roller comprises a rubberized bottom surface on said drive board and an abrasive surface on said associated roller.

6. Apparatus of the type claimed in claim 1, wherein said means for insulating said clay from said transport medium and said roller assembly comprises a sheet of canvas folded to cover the lower and upper surfaces of said mass of clay.

7. Apparatus of the type claimed in claim 4 wherein said drive board further includes means associated with said upper roller to facilitate driving of said upper roller.

8. Apparatus of the type claimed in claim 7 wherein said means to facilitate driving of said upper roller comprises a sheet of canvas attached to the front edge of said drive board.

9. Apparatus of the type claimed in claim 8 further comprising a flat surface support member extending through said assembly to facilitate driving said transport through said roller assembly.

* * * * *